United States Patent [19]

Krouskop

[11] Patent Number: 4,989,283

[45] Date of Patent: Feb. 5, 1991

[54] INFLATION CONTROL FOR AIR SUPPORTS

[75] Inventor: Thomas A. Krouskop, Stafford, Tex.

[73] Assignee: Research Development Foundation, Carson City, Nev.

[21] Appl. No.: 364,776

[22] Filed: Jun. 12, 1989

[51] Int. Cl.[5] ..... A61G 7/04

[52] U.S. Cl. ..... 5/453; 5/455

[58] Field of Search ..... 5/449, 453, 455, 456, 5/458, 469

[56] References Cited

U.S. PATENT DOCUMENTS 3,879,776 4/1975 Solen .
4,193,149 3/1980 Welch .
4,542,547 9/1985 Sato .
4,694,520 9/1987 Paul et al. .
4,797,962 11/1989 Goode .
4,873,737 10/1989 Savenije ..... 5/453

*Primary Examiner*—Michael F. Trettel
*Attorney, Agent, or Firm*—Fulbright & Jaworski

[57] ABSTRACT

A method of controlling the inflation of a body support, such as a mattress, having a plurality of air cells. The user is placed on the mattress and the air cells are inflated to provide the desired support in each of a plurality of positions. The height distance of all of the air cells are measured in each of the positions and respective positions. The position of the user on the mattress is determined from the height measurements and the inflation of the air cells is controlled to use the stored standards for the position of the user.

14 Claims, 10 Drawing Sheets

HS stands for Head slope
HSP stands for Head slope previous
A and B are the two distance measurements in the head section

TS = TOTAL SLOPE
LS = LEFT SLOPE
RS = RIGHT SLOPE

TS = TOTAL SLOPE
LS = LEFT SLOPE
RS = RIGHT SLOPE

KS = knee slope
FS = foot slope
I, J, K, L = distance values at the I, J, K, and L sensors

INFLATION CONTROL FOR AIR SUPPORTS

BACKGROUND OF THE INVENTION

The present invention is directed to controlling the inflation of air-filled supports, such as air mattresses and wheelchair cushions. Mattresses and wheelchair cushions that support the body on an air-filled bladder or cell are important tools for use in preventing pressure sores and in treating persons who have burns or pressure-induced soft tissue damage. The importance of maintaining proper body alignment for comfort and body function, as well as mimimizing peak pressures and controlling the pressure gradients across the skin, is well known.

While the desired inflation in each section of a support system may be properly set, depending upon the user or patient's position, the desired amount of inflation in each of the air cells differs when the position of the patient's body on the bed or support system changes.

The present invention provides a system to control and maintain the correct amount of air in the support system by measuring the height distance of each air cell, determining the position of the person lying on the air support, and controlling the inflation of the air cells to match the air support characteristics desired for the position of the patient on the support.

SUMMARY

The present invention is directed to a method of controlling the inflation of a mattress having a plurality of air cells and includes placing a user on the mattress in a first position, inflating the air cells to provide the desired support of the user, and measuring the height distance of all of the air cells, and storing the measurements of the height distances. Thereafter, the height distance of the air cells is monitored for determining the position of the user on the support and the inflation of the air cells is controlled when the user is in the first position to adjust the height distances of the air cells to the stored measurements.

Another object of the present invention is the method of determining the position of the user on the mattress by measuring the slope of the mattress cells caused by one or more of the body components.

Still a further object of the present invention is the method of controlling the inflation of a body support having a plurality of air cells which includes placing a user on the support in a first position, inflating the air cells to provide the desired support of the user in the first position, measure the height distance of all of the air cells while the user is in the first position, and storing the measurements of the height distances of the user in the first position. Thereafter, the user is placed on the support in a second position, the air cells are inflated to provide a desired support of the user in the second position, the height distance of all the air cells is measured while the user is in the second position, and the measurements of the height distances of the user in the second position is stored. Thereafter, using the height distance measurements of the air cells, the position of the user on the support is determined and the inflation of the air cells is controlled when the user is in the first or second position to provide the height distance of the air cells of the stored measurements of the first or second positions, respectively.

A still further object of the present invention is the method of controlling the inflation of a mattress having a plurality of air cells by placing a user on the mattress in the positions of supine position, right side position, and left side position and in each of the positions inflate the air cells to provide the desired support of the user in each of the respective positions, and measure and store the height distances of each of the cells for each of the positions. Thereafter, the height distance of the cells are measured for determining when the user is in the supine, right side or left side position on the mattress, and then controlling the inflation of the air cells to provide the stored height distances of each cell for the determined position.

Yet a further object of the present invention is the method of measuring the position of the user on the mattress by measuring the position of the user on the mattress by measuring the position of the body and legs of the user on the mattress by comparing distance measurements in the air cells.

Still a further object of the present invention is the provision of an inflation control system for a mattress having a plurality of air cells in which at least one distance measuring means is connected to each air cell for measuring the distance of the height of each cell, and an air supply means is connected to each cell. Control means are connected to the distance measuring means and control the air supply to each cell. The control means stores selected distance measurements for various positions of a user on the bed, determines the position of a user on the bed by measuring the distance measurements, and adjusts the distance measurements to conform to the selected measurements for the determined position of the user.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
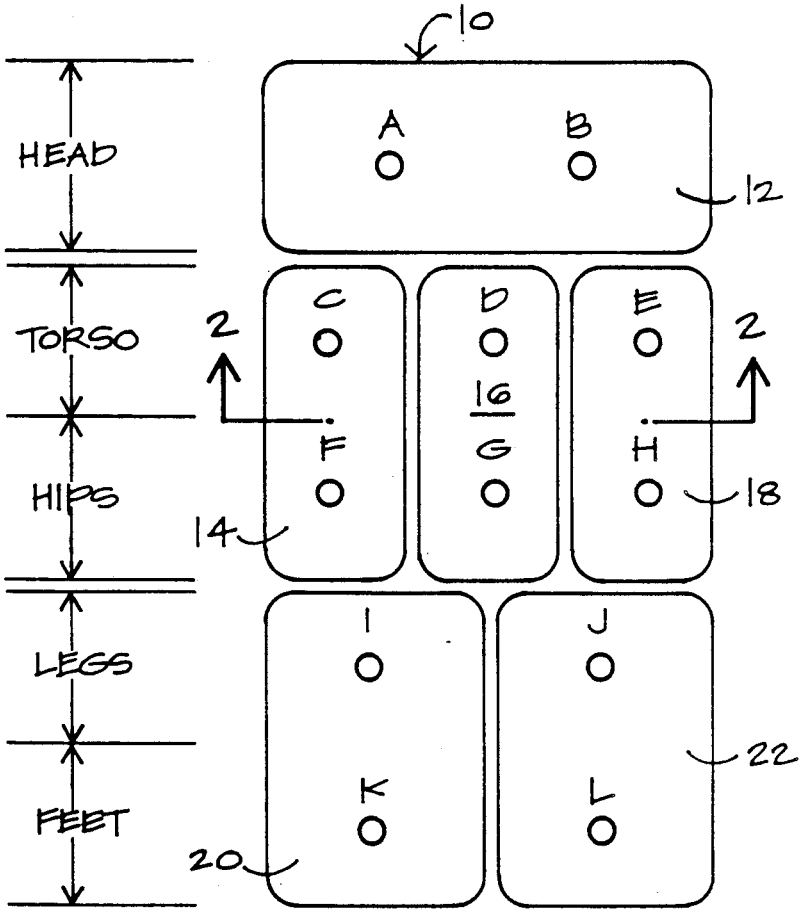
FIG. 1 is an elevational view of one form of the present invention illustrating an air mattress having a plurality of cells and distance measuring sensors.
Figure 2:
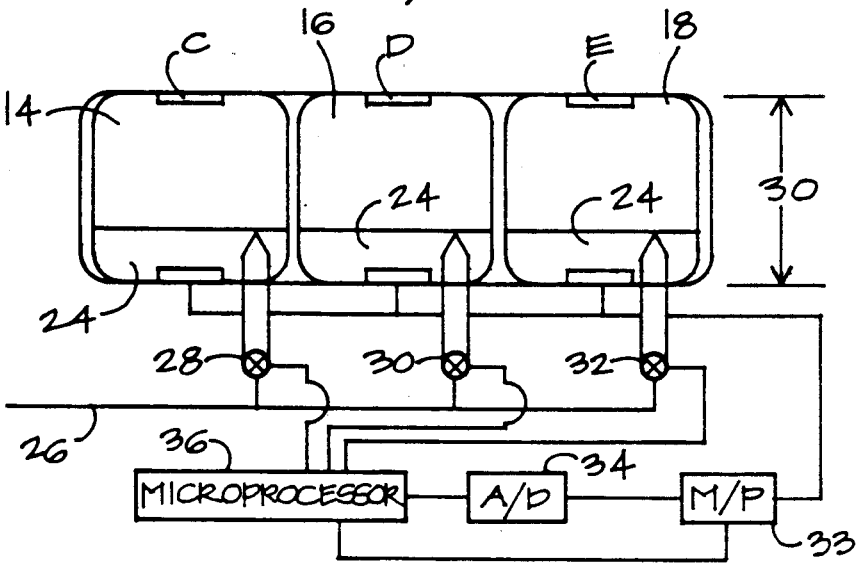
FIG. 2 is a cross-sectional view taken along the line 2—2 of FIG. 1 including control equipment connected thereto.

Referring now to the drawings, and particularly to FIGS. 1 and 2, the reference numeral 10 generally indicates an air-filled support system such as a mattress having a plurality of air cells 12, 14, 16, 18, 20 and 22. Each of the air cells includes at least one distance measuring means for measuring the distance of the height 30, that is the distance between the top and bottom of the air cells, of each of the cells. Thus, air cell 12 includes distance measuring sensors A and B, which are contacted by the head of a patient or user. Cell 14 includes sensors C and F with the sensor C being in position to be contacted by the torso of a body and F being contacted by hips of a body. Cell 16 includes sensors D and G, with sensor D positioned to be actuated by the torso and G by the hips. Cell 18 includes sensors E and F, actuated by the torso and hips, respectively. Cell 20 includes sensors I and K, and cell 22 includes sensors J and L. I and J are actuated by the legs of a user and K and L by the feet. The sensors may be of any suitable distance measuring means such as ultrasound proximity sensors/transducers such as sold by Polaroid.

Preferably, a polymer foam pad 24 is provided in the bottom of each of the air cells to provide effective support for the patient or user in the event that the air inflation system fails and also to allow a more solid support for performing CPR in the event it becomes necessary. The air cells are also fitted, as is conventional, with a quick release exhaust that will deflate the air cells rapidly if the user required CPR or other medical treatment that is best performed on a hard surface.

If desired, the air cells may be made of any suitable material, and if desired, can have a porous upper surface that permits a controlled flow of air from the air cells. This is conventionally used to control moisture and heat transfer from the person using the support system 10.

As best seen in FIG. 2, an air supply manifold 26 is provided, and a valve is connected between the air supply and each of the air cells. Thus, valves 28, 30 and 32 are provided connected to the air supply manifold 26 and to the air cells 14, 16, and 18, respectively. Information from the sensors, such as sensors C, D and E, are transmitted to suitable control equipment such as a multiplexer 33 for transmitting signals of the height distance 30 of each of the individual air cells. This information is transmitted through an analog to digital converter 34 to a suitable microprocessor 36. The microprocessor receives the information as to the height distance of each of the cells and periodically interrogates the multiplexer 33 when height data is desired. The microprocessor 36 in turn controls the operation of the valves, such as valves 28, 30 and 32, by admitting air into or exhausting air from each of the individual air cells. The control system is used to maintain a given stiffness in the air cells so that the interface pressure generated between the user and the support surface of the mattress 10 are minimized and so that the relative elevations of the air cells can be maintained to promote a desired posture.

The method of the present invention generally includes placing a patient or user on the mattress 10 in various positions, such as the supine position, right side position, and left side position. In each of these positions, the various air cells 12–22 are inflated to a desired geometry for the postural control and/or minimization of interface pressure. This preset is conventionally done by an operator and the geometry of the various air cells will depend upon the size, shape, weight, height, body build, of the patient or user, and in addition, will be determined by any disabilities of the patient or user such as pressure sores, burns, or posture requirements. Once the desired support parameters are achieved for each of the positions, the microprocessor 36 interrogates all of the sensors A–L for each of the positions to be preset and the height distance or data from each sensor is stored. Preferably, this information is obtained with the user in each of the supine position, the right side position and the left side position. Of course, the desired geometry for the postural control or minimization of interface pressure will be different for each of the positions. The stored values of the distance heights of each of the air cells for each of the positions is used as a standard. That is, each time the patient or user moves to a new position, the microprocessor 36 will sense the new position and will adjust the admission or release of air from each of the air cells 12–22 to provide the distance heights for each of the cells for the present position of the user. In addition, the position of the user on the mattress 10 is determined by measuring the distance heights of each of the sensors A–L. Thus, the system will automatically measure the position of the user or patient on the mattress 10 and will automatically adjust the amount of air required in each of the air cells to provide the preset geometry for the determined body position.

The ability of the distance height measuring sensors A–L to measure various body positions allows the present application to automatically control the inflation of the air cells 12–22 whenever the patient or user changes position on the mattress 10 to provide the desired preset height standards. Such an operation and result is obtained quickly and efficiently without requiring outside assistance and/or resetting of the air cell parameters to achieve the desired surface configuration. For example, referring to FIG. 10, various possible positions for the torso is shown relative to the height sensors C, D and E. From these possibilities listed in FIG. 10, it is noted that the location of the torso 40 relative to the air cells 14, 16 and 18 can be determined. The use of this information in the logic flow charts will be more fully described hereinafter.

Figure 11:
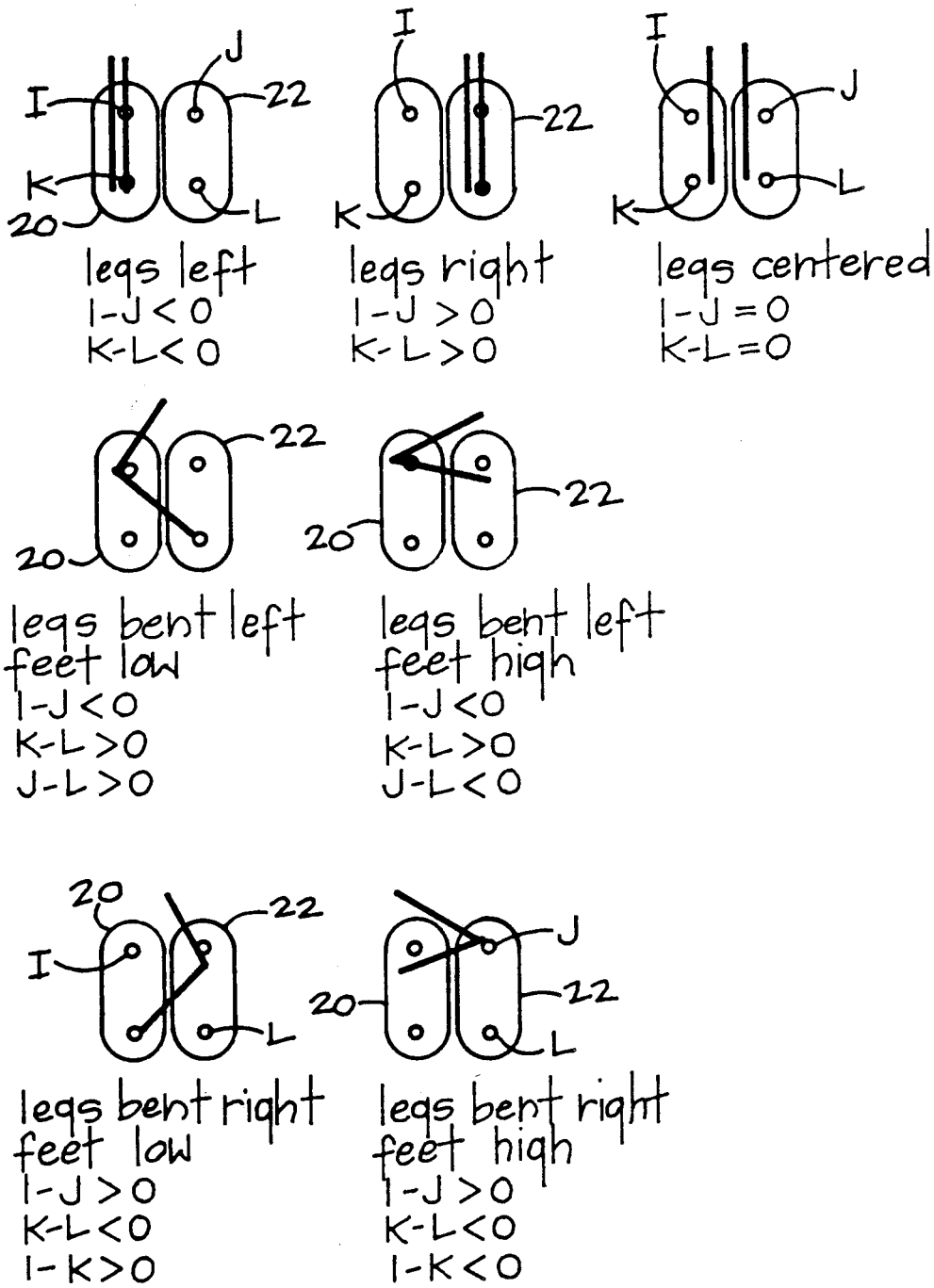

Referring now to FIG. 11, various possible leg and feet positions of a patient or user is shown relative to the air cells 20 and 22 and their height sensors I and K, and J and L, respectively. It is to be noted that the outputs from the various sensors I, K, J and L can be compared as indicated in FIG. 11 to locate various possible leg and feet positions. This information is used as will be more fully described in a logic flow diagram for determining the position of a patient or user on the air mattress 10.

Figure 3:
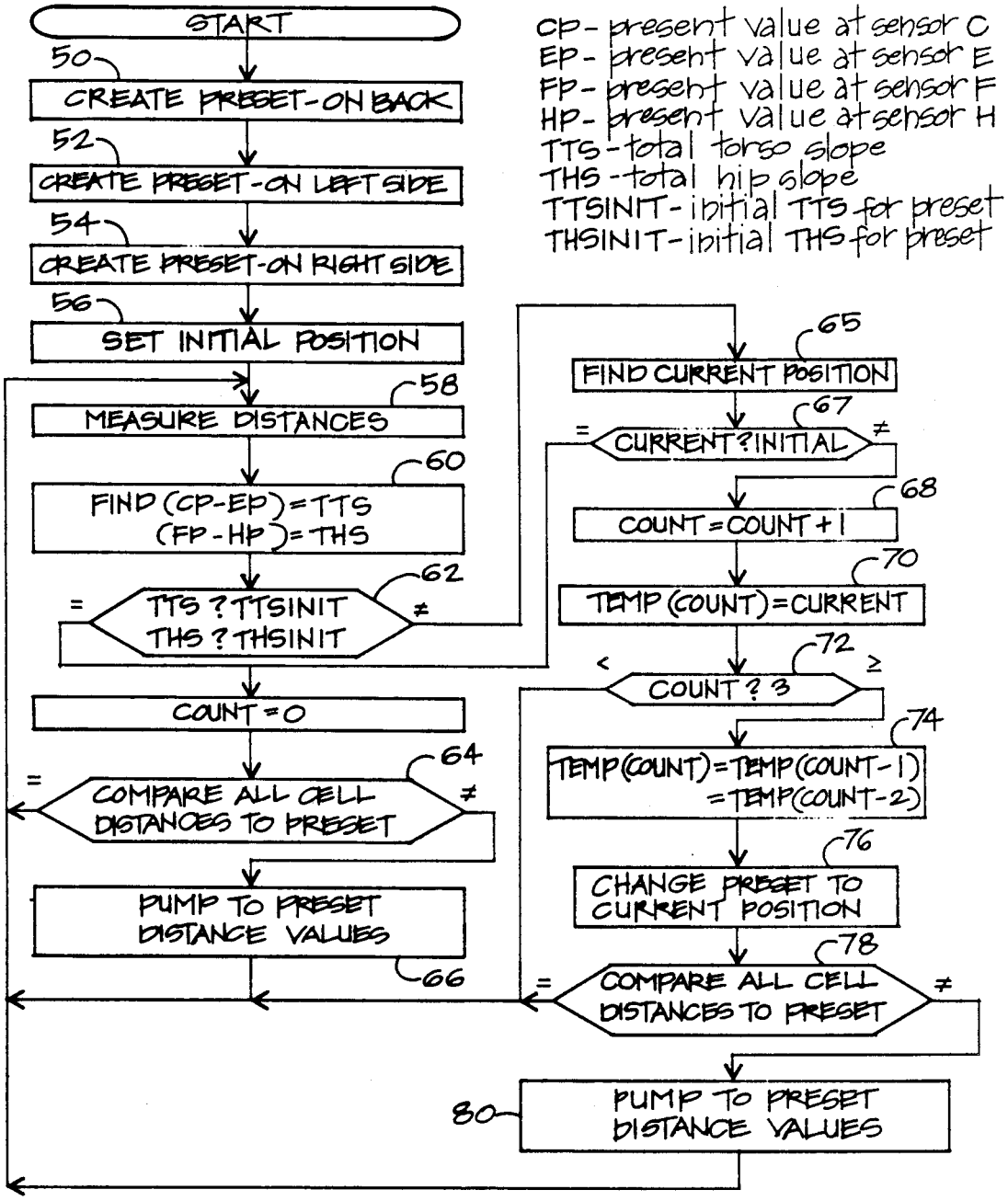
FIG. 3 is an overall logic flow chart for controlling the inflation of the air in the air cells.

Referring now to FIG. 3, an overall logic flow chart is shown for controlling the operation of the microprocessor 36 either by software or hardware. After starting, the patient or user is placed on the mattress 30 in a supine position, such as on his back or stomach, and the various individual air cells 12–22 are inflated to the desired geometry for postural control or minimization of interface pressure between the user and the mattress. The required inflation of the air cells is something that an operator skilled in the art can accomplish taking into consideration various factors such as the condition of the patient, his disabilities, and his size, height, weight and body shape. When this is accomplished, the height of the various air cells and each of the height sensors A-L are measured to provide a preset step 50 of the inflation parameters that are desired for this particular supine position. In this preset step 50, the microprocessor 36 obtains the height measurements from the height sensors and stores that data so as to, at a later time, regulate the various air valves to reestablish the same height parameters when the patient or user moves from a different position back to the supine position.

Next in step 52, a preset is created with the user or patient now placed on the mattress 30 on his left side. Again, the various air cells 12-22 are inflated to a desired geometry to secure the desired support characteristics for the individual in the left side position. Once the air cells are appropriately inflated, the microprocessor 36 interrogates the sensors A-L, obtains the height data and stores the height data for the left side position. In step 54, the individual is placed on his right side on the mattress 30, and a preset is created from all of the measurements of the various sensors A-L with the air cells adjusted to provide the desired inflation for the user in the right side position.

The control system is now operational after creating the presets in steps 50, 52 and 54 for the patient or user used in the setup The information which has been measured and stored provides a standard to control the inflation of the air cells when the user is in any one of the three preset positions. In addition, the stored sensor data also assists in determining the location of the position of the user as will be described hereinafter. In step 56, the operational function of the system is started with the individual in one of the three positions, supine position, left side position or right side position. In step 58 the distances or heights of the sensors are measured. In step 60 the total torso slope (TTS) which is the present difference between the distances of sensors C and E. Also, the total hip slope (THS) is measured which is the present difference between the distances of sensors F and H. These two slope measurements quickly determine whether or not the user is in the same position mode as initially. That is, the torso and hip measurements comprise the body measurement. In step 62, the slopes computed in step 60 are compared with the initial slopes for the preset. If the user has not changed position, then the measured slopes will be equal to the initial slopes. If the measured slopes are equal to the initial slopes, then the user is in the same position and in step 64 all of the cell heights or distances as measured are compared to the preset stored values and if they are all the same, the process recycles to step 58 and continues. If any of the cell heights are different from the preset and stored values, step 66 is entered to cause the air cells to be inflated or deflated to reach the preset distance or height values. After this has been done, the cycle again recycles to step 58.

Referring back again to step 62, in the event that the total torso slope (TTS) and total hip slope (THS) as presently measured did not equal the initial slopes TTSINIT and THSINIT, then the program would enter step 65, which will be more fully discussed hereinafter, which measures and finds the current position of the user on the mattress 30. If the current position is found to be equal to the initial position in step 67, then the process recycles back to step 64. On the other hand, if the current position is not the same as the initial position, the program moves to step 68 which is count 1. The 35 present system monitors changes in the sensors A-L once a minute, or any other convenient time scale, but significant changes must be maintained for three consecutive measurements before the processor 36 actuates the valves to cause a change in the inflation of the air cells. The program continues through steps 70, 72 and 74 to determine whether the current change is maintained for three counts. In the event the change in position has been maintained for three counts, in step 76 the preset position is changed to the current position as a standard. The values, for example, for position may be changed to the current measured position, for example, from a back position to a left side position. And in step 78, the microprocessor 36 again compares all of the cell heights of the air cells to the new preset position and if the air cells need more or less air, step 80 is performed; otherwise, the process recycles to step 58 using the new preset values.

Figure 4:
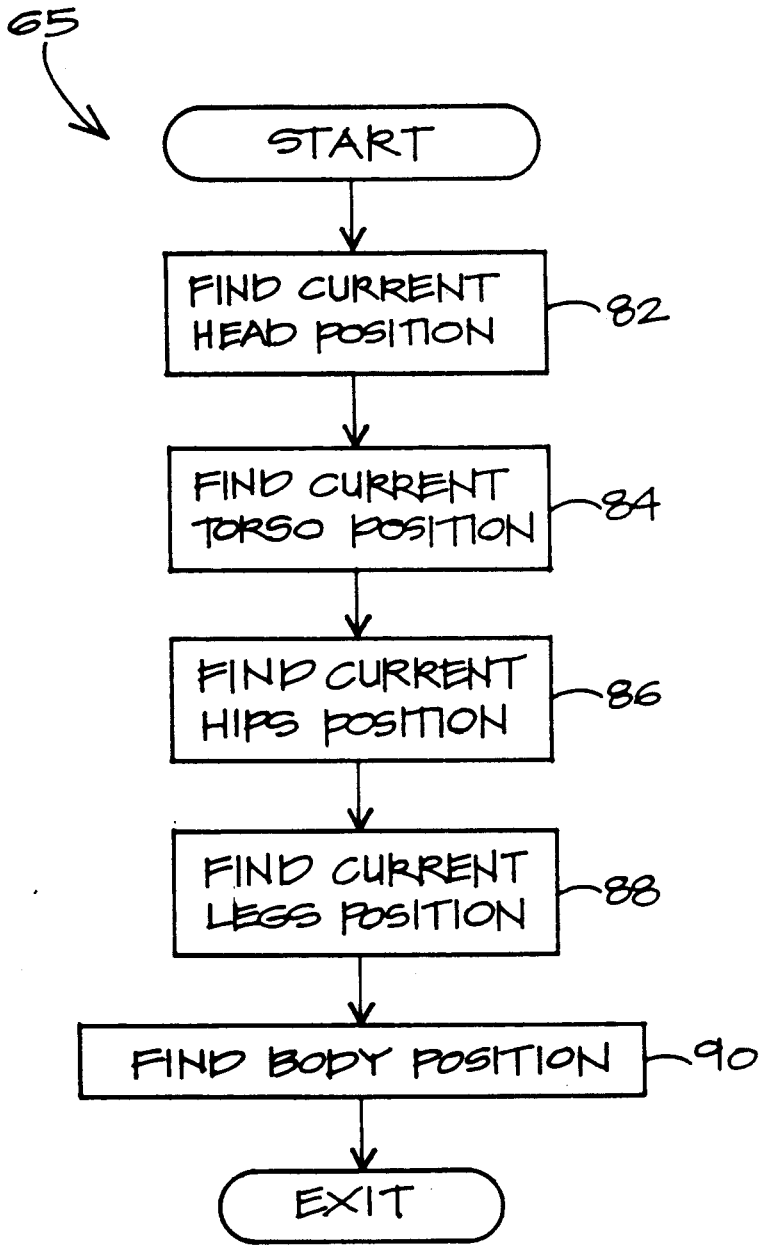
FIG. 4 is a logic flow chart for finding the current position of a user on the mattress of FIG. 1.
Figure 5:
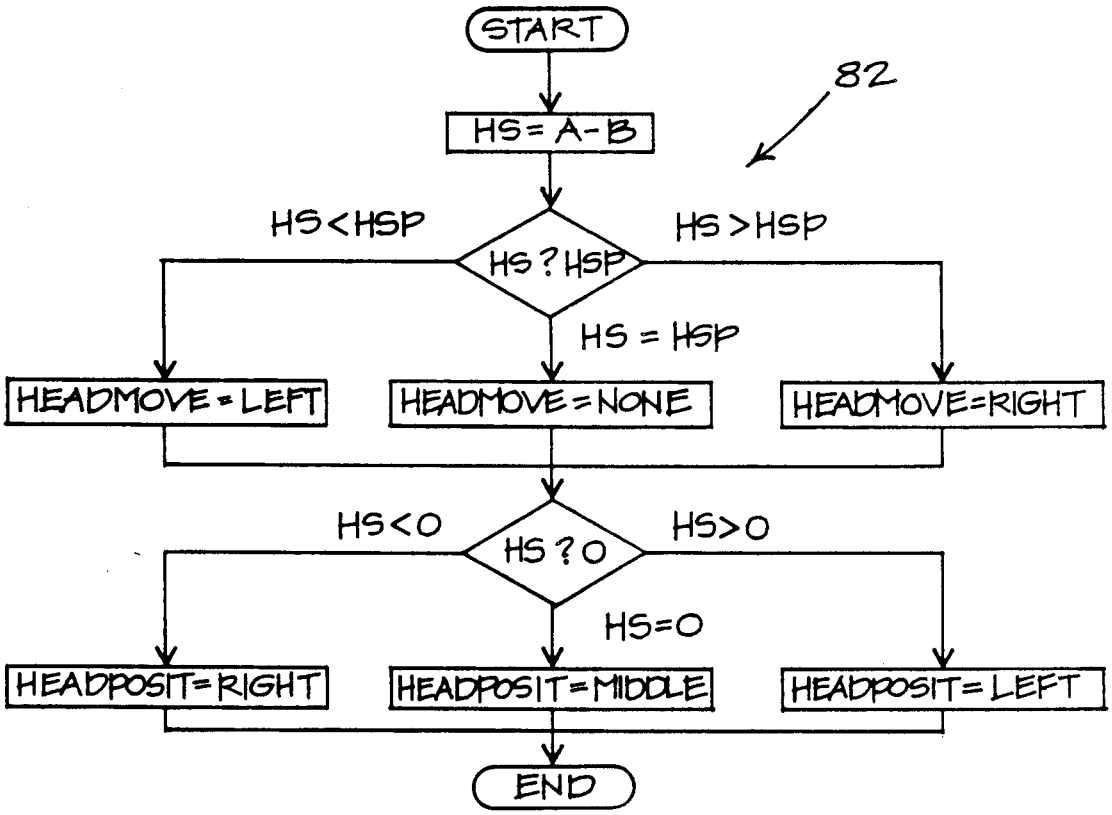
FIG. 5 is a logic flow chart for locating the head position.

The step 65 of finding current position is set out in a subroutine in FIG. 4 and includes the steps 82 of finding the current head position, step 84 of finding the current torso position, the step 86 of finding the current hip position, the step 88 of finding the current legs and feet position, and in step 90 the final body position is determined. FIG. 5 is a further subroutine of the find head position step routine 82. While the head position is not used as a factor in determining the overall body position of step 90, which will be discussed more fully hereinafter, the head position is used to locate the position of the head on air cell 12 by measuring the slope between the heights of sensors A and B in order to determine if there has been change in the position of the head and provide the correct amount of inflation to the air cell 12 depending upon the position of the user. The comparison of the heights and the comparison of the present head slope (HS) relative to the previous head slope (HSP) determines as indicated in the flow chart of FIG. 5 whether the head has moved, in which direction, and its current position.

Figure 6:
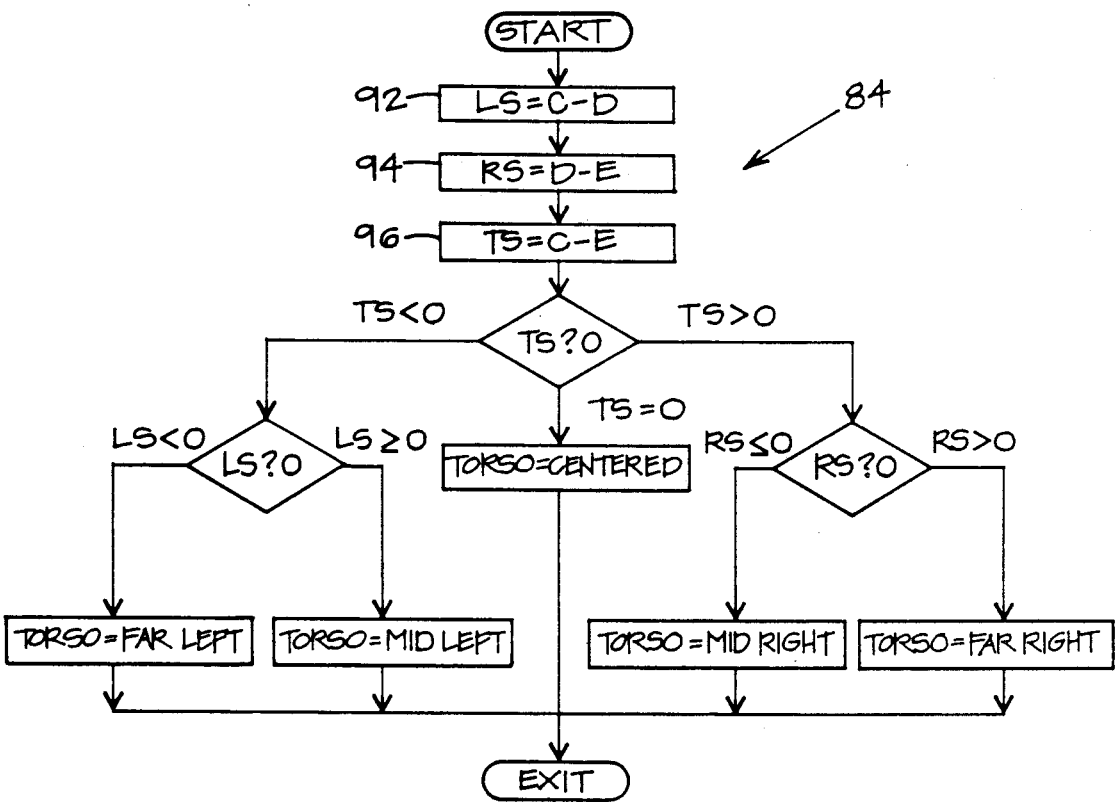
FIG. 6 is a logic flow diagram for finding the position of the torso on the mattress.
Figure 9:
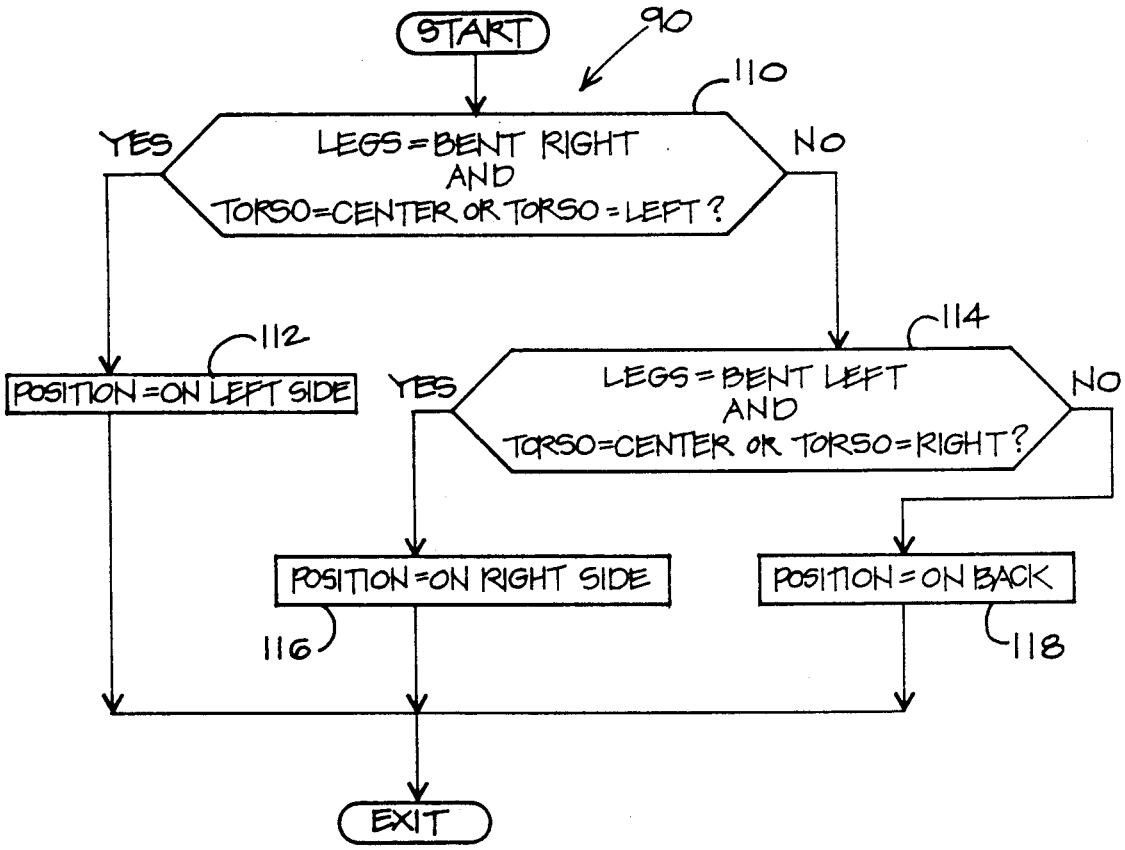
FIG. 9 is a logic flow chart for finding the overall body position.
Figure 10:
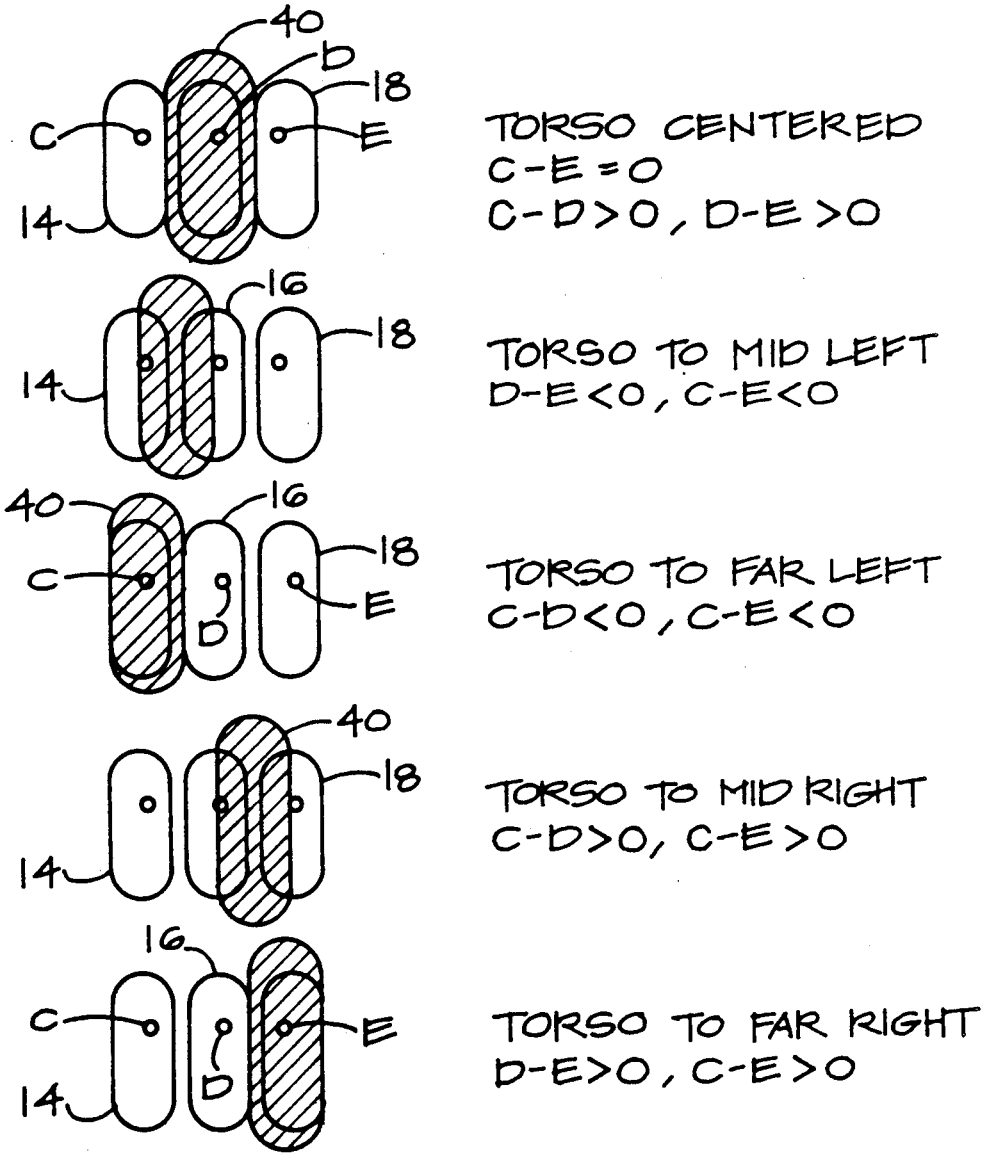
FIG. 10 is a schematic illustrating the outputs of the sensors in response to various possible positions of the body, FIG. 11 a schematic of various possible leg positions and the corresponding sensor outputs.

The subroutine 84 of finding the current torso position is best seen in FIG. 6 and determines which of the possible torso positions set forth in FIG. 10 is being measured. Steps 92, 94, and 96 determine various slopes with the left slope (LS) being determined by the difference between the measured distance of sensor C minus the distance of sensor D. Similarly, step 94 measures the right slope (RS) which is the difference in height of the sensor D less sensor E. And the total slope (TS) is a measurement of the difference of the height of sensor C minus the height of sensor E. Of course, if the total slope is zero, the body is centered, and if the total slope is less than zero, the body is either at the far left or the mid-left, depending upon the value of the left slope. Thus, the flow chart in FIG. 6 determines whether the torso is positioned at the far left, mid-left, centered, mid-right, or far right. This information is utilized to find the overall body position as will be more fully described in connection with FIG. 9.

Figure 7:
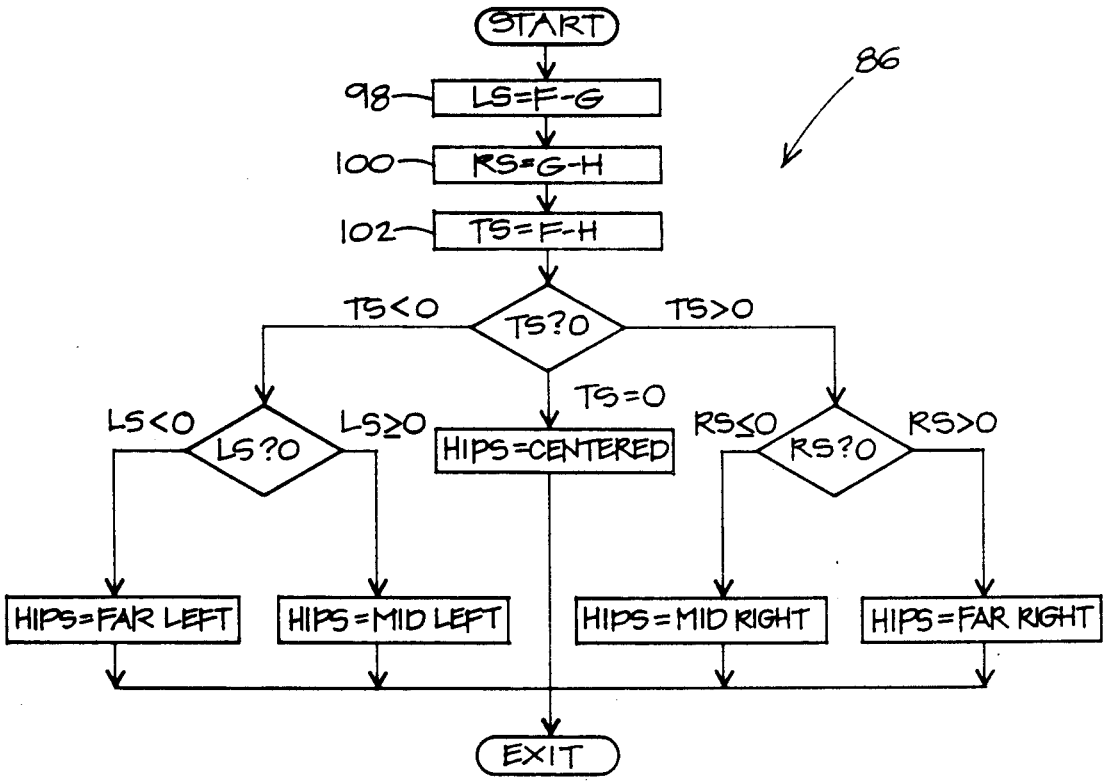
FIG. 7 is a logic flow chart for finding the position of the hips on the mattress.

The step 86 of finding the current hip position is best seen in FIG. 7 and is very similar to the calculations to determine the torso position of FIG. 6. The calculations are similar in that the left slope (LS) is determined by the height of sensor F minus the height of sensor G, the right slope (RS) is determined by the height of sensor G minus the height of sensor H and the total slope (TS) is determined by the height of sensor F minus the height of sensor H. Again, by calculating the values of the measured slopes, the position of the hips as being far left, mid-left, centered, mid-right, or far right can be determined. While this determination is not necessary for determining the overall body position since the position of the torso as determined in FIG. 6 will provide that factor, the position of the hips is useful in properly inflating or deflating the air cells 14, 16 and 18 to provide the desired geometry for supporting the hips depending upon the measured position. For example, the hips require different support than the upper torso. And during sitting in bed, the geometry will be different.

Figure 8:
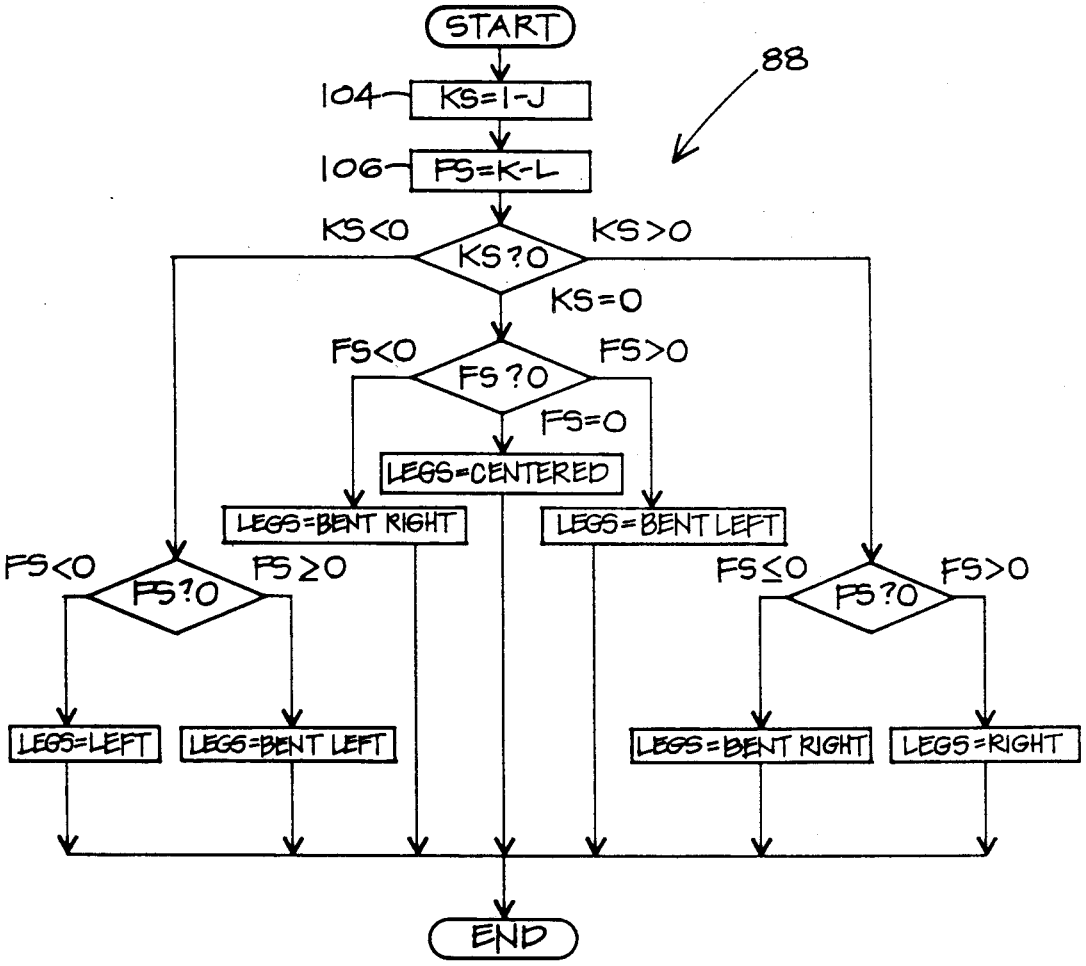
FIG. 8 is a logic flow chart for finding the leg position on the mattress.

Referring now to FIG. 8, the subroutine 88 for finding the current leg and feet position is best seen. The measurements and calculations set forth in the flow chart of FIG. 8 make the measurements of the possible leg and feet positions set forth in the diagram of FIG. 11. The knee slope (KS) is equal to the height of sensor I minus the height of sensor J. The foot slope (FS) is the height distance of sensor K minus the height distance of sensor L. By comparing the various slopes, a determination can be made as to which of the positions the legs and feet are in, as shown in FIG. 11.

Referring now to FIG. 9, the subroutine for step 90 is shown of finding the overall body position. The routine 90 in step 110 determines from the output of subroutine 88 in FIG. 8 if the legs are bent right and whether the torso from FIG. 6 in subroutine 84 is in the center or the left. If the answer is yes, then step 112 determines that the individual is in position on the left side. If the answer is no, step 112 compares whether the legs are bent left (from FIG. 8) and whether the torso is in the center or right (from FIG. 6). If the answer is yes, a determination is made in step 116 that the patient or user is in position on the right side. If the answer is no, step 118 determines that the patient is supine position, either on the back or on the front.

If the head of the mattress 30 is raised to permit the user to be positioned in a sitting position, the slope of the center air cells 14, 16 and 18 is recognized as indicative of sitting and the center cells 14, 16 and 18 are inflated until their heights are adjusted for the supine position. If pressure of fluid in the cells were used to control inflation, when the head of the bed is lifted, the user's buttocks will "bottom-out" and pressure will not easily correct the error — by using cell height measurements the correction can be made efficiently.

The method of the present invention automatically controls the inflation of the air cells in the mattress 30 and automatically measures when the patient or user makes a change in position and then controls the inflation of the air cells to adjust them in accordance with the measured position.

The present invention, therefore, is well adapted to carry out the objects and attain the ends and advantages mentioned as well as others inherent therein. While presently preferred embodiments of the invention have been given for the purpose of disclosure, numerous changes in the details of construction, arrangement of parts and steps of the process will be readily apparent to those skilled in the art and which are encompassed within the spirit of the invention and the scope of the appended claims

What is claimed is:

1. A method of controlling the inflation of a mattress having a plurality of air cells comprising, placing a user on the mattress in a first position, inflating the air cells to provide the desired support of the user, measuring the height distance of each of the air cells at plural points, storing the location and measurement of the plural height distances of all of the cells, monitoring the height distance of the air cells and determining the position of the user on the mattress, and controlling the inflation of the air cells when the user is in the first position to adjust the height distance of the air cells to the stored measurements.

2. The method of claim 1 including, determining the position of the user on the mattress by measuring the slope of the top of the mattress caused by a component of the body of the user.

3. The method of claim 2 wherein the slope is measured by measuring the difference in height between two transversely spaced height distance measurements.

4. The method of claim 2 wherein the slope is measured by measuring the slope in a direction across the width of the mattress.

5. The method of claim 2 including measuring the slope of the top of each air cell by measuring the height distance of each air cell at two transversely spaced locations in each air cell.

6. The method of claim 5 wherein the air cells include, a first single air cell for receiving the head of a person, a second, third and fourth air cells which are parallel to each other and positioned adjacent to and perpendicular to the first air cell, and fifth and sixth air cells which are positioned parallel to each other and positioned adjacent to said second, third and fourth air cell.

7. A method of controlling the inflation of a body support having a plurality of air cells comprising, placing a use on the support in a first position, inflating the air cells to provide the desired support of the user in the first position, measuring the height distance of all of the air cells at two locations in each air cell while the user is in the first position, storing the locations and measurements of the height distances of the user in the first position, placing the user on the surface in a second position, inflating the air cells to provide the desired support of the user in the second position, measuring the height distance of all of the air cells at two locations in each air cell while the user is in the second position, storing the measurements of the height distances of the user in the second position, using the height distance measurements of the air cells and determining the slope of the top of the support and the position of the user on the support, and controlling the inflation of the air cells when the user is in the first or second position to height distances of the air cells of the stored measurements of the first or second positions, respectively.

8. A method of controlling the inflation of a mattress having a plurality of air cells comprising, placing a user on the mattress in the positions of supine position, right side position, and left side position, in each of the positions inflate the air cells to provide the desired support of the user in each of the respective positions, measure and store the location and height distances of each of the air cells at plural points for each of the positions, hereafter measuring the height distances of the cells and determining the transverse slope of the top of the mattress from the height distances thereby determining when the user is in the supine, right side or left side position on the mattress, and controlling the inflation of the air cells to provide the stored height distances of each cell for the determined position.

9. The method of claim 8 including, measuring the position of the user on the mattress by measuring the position of the body and legs of the user on the mattress by comparing distance measurements in the air cells.

10. An inflation control system for a mattress having a plurality of air cells comprising, at least one distance measuring means connected to each air cell for measuring the distance of the height of each cell and for measuring the slope of the top of each air cell transversely with respect to the mattress the mattress, air supply means connected to each cell, control means connected to the distance measuring means and controlling the air supplied to each cell, said control means storing selected distance measurements for various positions of a user on the mattress, determining the positions of a user on the mattress by measuring the distance measurements, and adjusting the distance measurement to conform to the selected measurements for the determined position of the user.

11. The apparatus of claim 10 wherein each air cell includes two distance measuring means.

12. The apparatus of claim 11 wherein the mattress includes a plurality of air cells positioned parallel to each other and said air cells have a longitudinal axis parallel to the longitudinal axis of the mattress.

13. A method of controlling the inflation of a mattress having a plurality of air cells comprising, placing a user on the mattress in a first position, inflating the air cells to provide the desired support of the user, measuring the height distance of all of the air cells by a plurality of height measuring distance sensors spaced longitudinally and transversely from each other in the mattress, storing the location and measurement of the height distances of all of the sensors, measuring the slope of the top of the mattress between adjacent transversely spaced sensors and determining the position of the user on the mattress and, controlling the inflation of the air cells when the user is in the first position to adjust the height distance of the air cells to the stored measurements.

14. The method of claim 13 wherein the slope is measured by measuring the distance in height between adjacent transversely positioned sensors.

* * * * *

UNITED STATES PATENT AND TRADEMARK OFFICE

CERTIFICATE OF CORRECTION

PATENT NO. : 4,989,283

DATED : February 5, 1991

INVENTOR(S) : Thomas A. Krouskop

It is certified that error appears in the above-identified patent and that said Letters Patent is hereby corrected as shown below:

Title Page:
In the Abstract, line 6, after "and" insert -- the measurements are stored and used as a standard for the --.

Column 5, line 24, after "setup" insert --.

Column 5, line 66, delete "35"

Column 7, line 59, after "claims" insert--.

Column 8, line 36, delete "use" and insert --user--.

Column 8, line 44, delete "surface" and insert -- support--.

Signed and Sealed this

Eighth Day of December, 1992

*Attest:*

DOUGLAS B. COMER

*Attesting Officer*

*Acting Commissioner of Patents and Trademarks*